US006752640B2

(12) United States Patent
Chen

(10) Patent No.: US 6,752,640 B2
(45) Date of Patent: Jun. 22, 2004

(54) ELECTRICAL CONNECTOR WITH A COMMON GROUND PLATE

(76) Inventor: Wan-Tien Chen, 10F, No. 106-2, Sec. 2, Chungshan N. Rd., Taipei (TW)

( * ) Notice: Subject to any disclaimer, the term of this patent is extended or adjusted under 35 U.S.C. 154(b) by 36 days.

(21) Appl. No.: 10/156,446

(22) Filed: May 28, 2002

(65) Prior Publication Data

US 2003/0224634 A1 Dec. 4, 2003

(51) Int. Cl.[7] ..... H01R 13/648
(52) U.S. Cl. ..... 439/92
(58) Field of Search ..... 439/92, 939, 541.5, 439/607, 581, 578, 79, 83, 439

(56) References Cited

U.S. PATENT DOCUMENTS 6,004,146 A * 12/1999 Tan et al. ..... 439/92
6,109,936 A * 8/2000 Tan et al. ..... 439/92
6,290,508 B1 * 9/2001 Wu ..... 439/76.1

* cited by examiner

*Primary Examiner*—J. F. Duverne
(74) *Attorney, Agent, or Firm*—James W. Kayden; Thomas, Kayden, Horstemeyer & Risley, LLP

(57) ABSTRACT

An electrical connector has a body and ground plate mounted on the body. The body has a mounting surface that defines several openings to receive signal terminals. The ground plate is mounted on the mounting surface and electrically contacts with each signal terminal, wherein a single ground pin extending from the ground plate is shared by all signal terminals. Therefore, the total amounts of conductive pins of the electrical connector is reduced, and the complexity of mounting process is able to be simplified when the electrical connector is jointed to a circuit board.

7 Claims, 5 Drawing Sheets

ELECTRICAL CONNECTOR WITH A COMMON GROUND PLATE

BACKGROUND OF THE INVENTION

1. Field of Invention

The present invention relates to an electrical connector, and more particularly to an electrical connector utilizes a ground plate to collectively and electrically contact with multiple signal terminals, whereby only a single ground pin extending from the ground plate is needed to mounted on a circuit board.

2. Related Art

With reference to FIG. 4, the structure of a conventional electrical connector is shown. In FIG. 5, the connector of FIG. 4 is jointed to a circuit board, such as a main board (90) for the computer. The electrical connector mainly comprises two parts, wherein the upper part is a female connector (70) with 15 contact holes to correspondingly link with a male connector with 15 pins, such as a male connector of the computer joystick. The lower part of the electrical connector is formed as a rectangular body (80) equipped with three signal terminals (71), wherein the common specifications of the three signal terminals are the line output, line input and microphone joint.

Each signal terminal (71) is composed of a ground base (72) and a conductive copper sleeve (73) formed on the ground base (72). A colored rubber ring (74) is further put around the copper sleeve (73), thus the user can recognize the kind of the signal terminal (71) based on the color of the rubber ring (74).

The ground base (72) made up of conductive metal and includes a substantially square sheet, and two pairs of buckling plates (721) respectively and perpendicularly formed on opposite flanges of the square sheet, wherein a ground pin (75) further extends from a flange of the square sheet and between one paired buckling plates (721). The extending direction of the ground pin (75) is relative to that of the buckling plates (721).

The rectangular body (80) is formed with three ports each to receive a signal terminal (71). Each port is defined with a groove (81) to receive one pair of the buckling plates (721) of the ground base (72). At the bottom of the rectangular body (80), multiple protrusions (82) are integrally formed to correspondingly buckle with the other pair of the buckling plates (721). Each port is further has a hole (83) defined at the center, whereby when the signal terminal (71) is equipped to the port, a plug (not shown) of an electrical instrument, such as the plug of the earphone, the plug is able to insert into the hole (83) through the copper sleeve (73). The plug is then electrically contacted with signals pins (84) extending out from the bottom of the body (80).

As shown in FIG. 4, when signal terminals (71) are respectively inserted into the ports, multiple conductive pins including signal pins (84) and ground pins (75) are disposed at the bottom of the body (80). As shown of this connector, the three ground pins (75) are all for connecting with ground, but each is individually protruded from a signal terminal, therefore, the total number of conductive pins is increased. When the connector is welded to a main board, such a quantity of conductive pins will increase the complexity of the welding process and the processing time is prolonged. Furthermore, if one ground pin (75) is not well jointed at the main board, the corresponding signal terminal (71) will become faulty.

To overcome the shortcomings, an electrical connector with a common ground plate in accordance with the present invention obviates or mitigates the aforementioned problems.

SUMMARY OF THE INVENTION

The primary objective of the present invention is to provide an electrical connector that utilizes a common ground plate to collectively contact all signal terminals disposed in the electrical connector so as to simply the jointing process when the electrical connector is welded to a circuit board.

To achieve the objective, the electrical connector comprises a body and a ground plate. The body is defined with openings to receive signal terminals. Multiple signal pins are further disposed inside the body and extends out from the bottom of the body to joint at the circuit board.

The ground plate is mounted on the body to electrically contact with all signal terminals, wherein a ground pin is integrally formed on and extends from the ground plate to connect at the circuit board.

Other objectives, advantages and novel features of the invention will become more apparent from the following detailed description when taken in conjunction with the accompanying drawings.

DETAILED DESCRIPTION OF THE INVENTION

Figure 1:
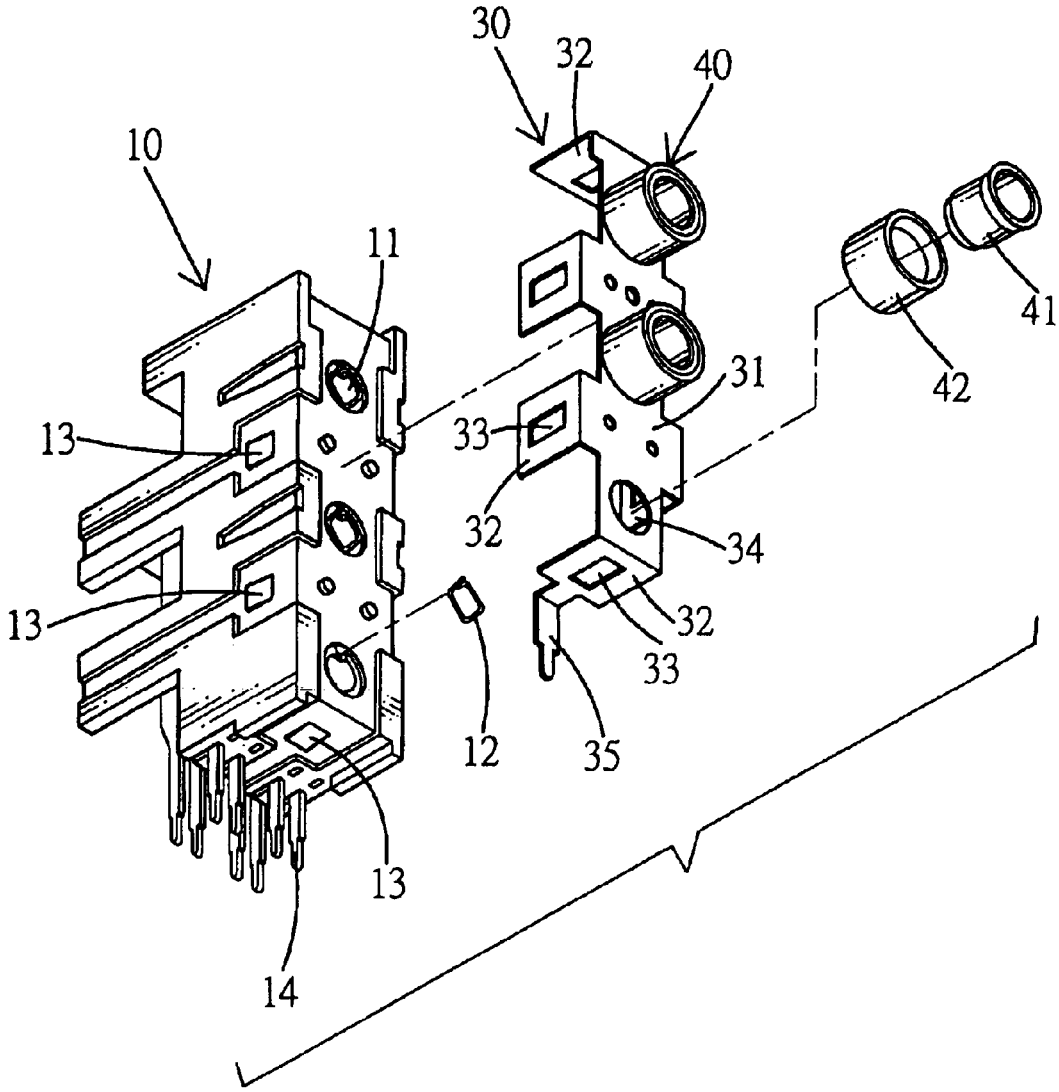
FIG. 1 is an exploded perspective view of an electrical connector in accordance with the present invention.

With reference to FIG. 1, an electrical connector in accordance with the present invention comprises a body (10) and a ground plate (30) mounted on the body (10). The body (10) is formed as a substantially rectangular body and defined with three openings (11) at a mounting surface. A metal ring (12) is placed at the rim of each opening (11) to slightly clip a plug of an electrical product (not shown) inserted into the opening (11).

The body (10) further has multiple protrusions (13) integrally formed at surfaces adjacent to the mounting surface to buckle with the ground plate (30). A plurality of signal pins (14) is disposed inside the body (10) and extends out from a bottom surface of the body (10).

The shape and size of the ground plate (30) is formed to correspond the mounting surface of the body (10). Multiple buckling plates (32) are perpendicularly and integrally formed along the edges of a platform (31) of the ground plate (30), wherein each buckling plate (32) is defined with a buckling hole (33) to correspondingly to clasp a protrusion (13) of the body (10). A plurality of through holes (34) is defined at the ground plate and corresponds to the openings (11) on the body (10). A ground pin (35) is perpendicularly formed at and extends from one buckling plate (32) buckled at the bottom surface of the body (10), whereby the ground pin (35) is parallel to all signal pins (14).

Each through hole (34) on the ground plate (30) is allowed to retain a signal terminal (40) therein. Each signal terminal (40) comprises a conductive sleeve (41) and a colored rubber ring (42) provided to surround the conductive sleeve (41). Based on the different colors of the rubber ring (42), the user can recognize the signal terminal (40) is for the line input, line output or microphone connector etc.

Figure 2:
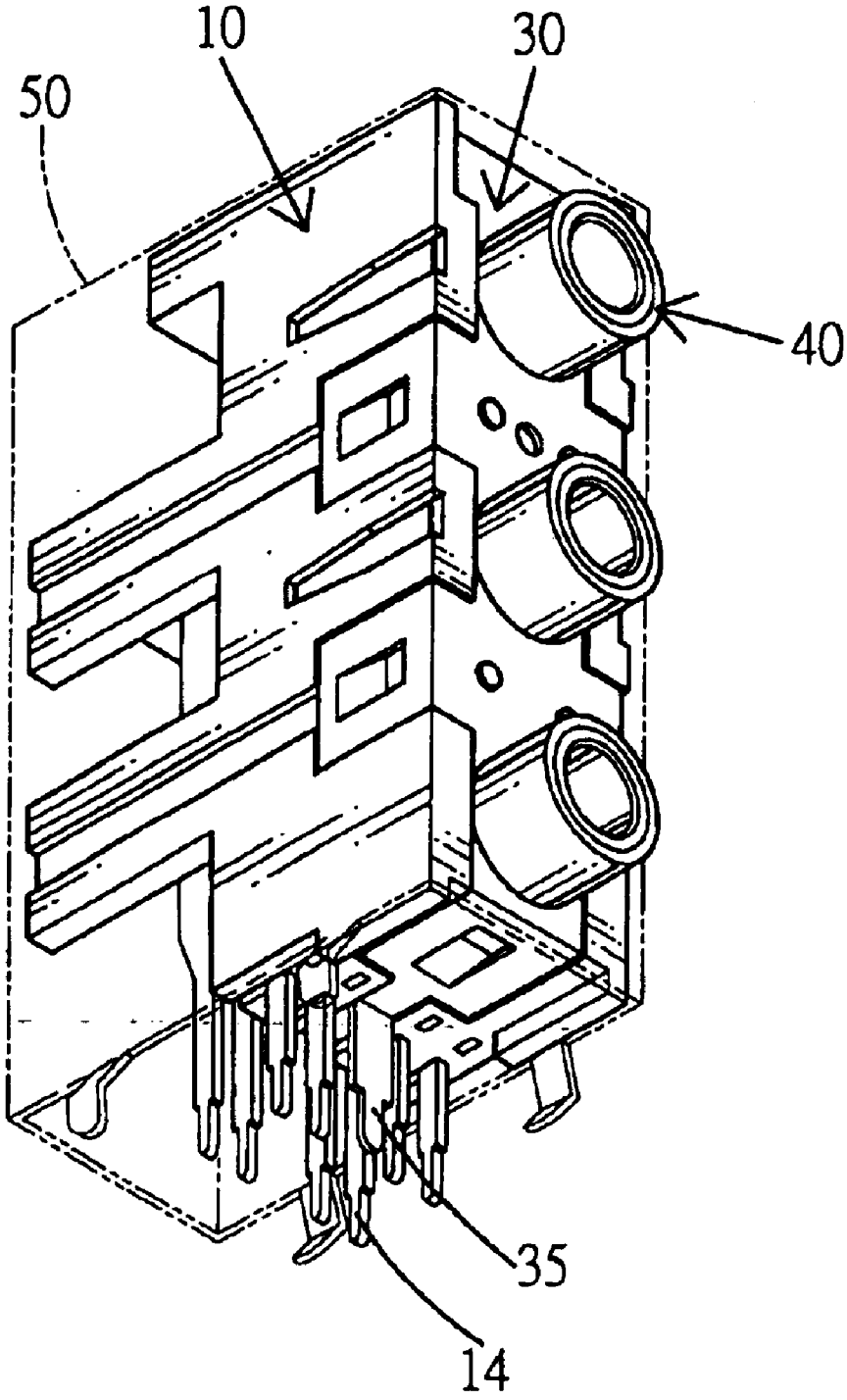
FIG. 2 is a perspective view of the assembled electrical connector of FIG. 1 in accordance with the present invention.

With reference to FIG. 2, when all elements mentioned above are assembled together, a metal covering (50) (as shown by dotted line) can further applied to cover the electrical connector to prevent electromagnetic interference.

Figure 3:
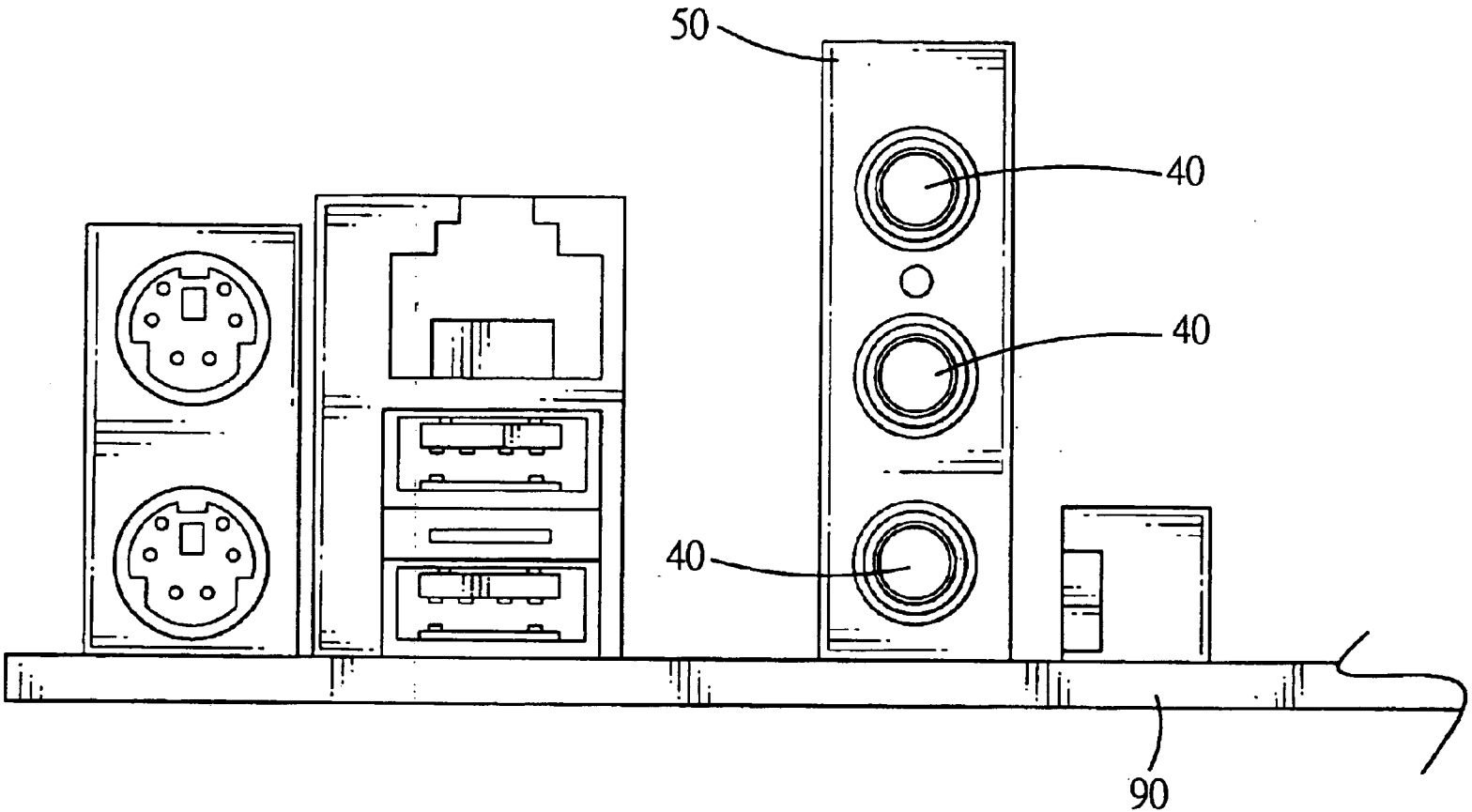
FIG. 3 is an operation view showing the electrical connector of FIG. 2 is mounted to a main board.
Figure 4:
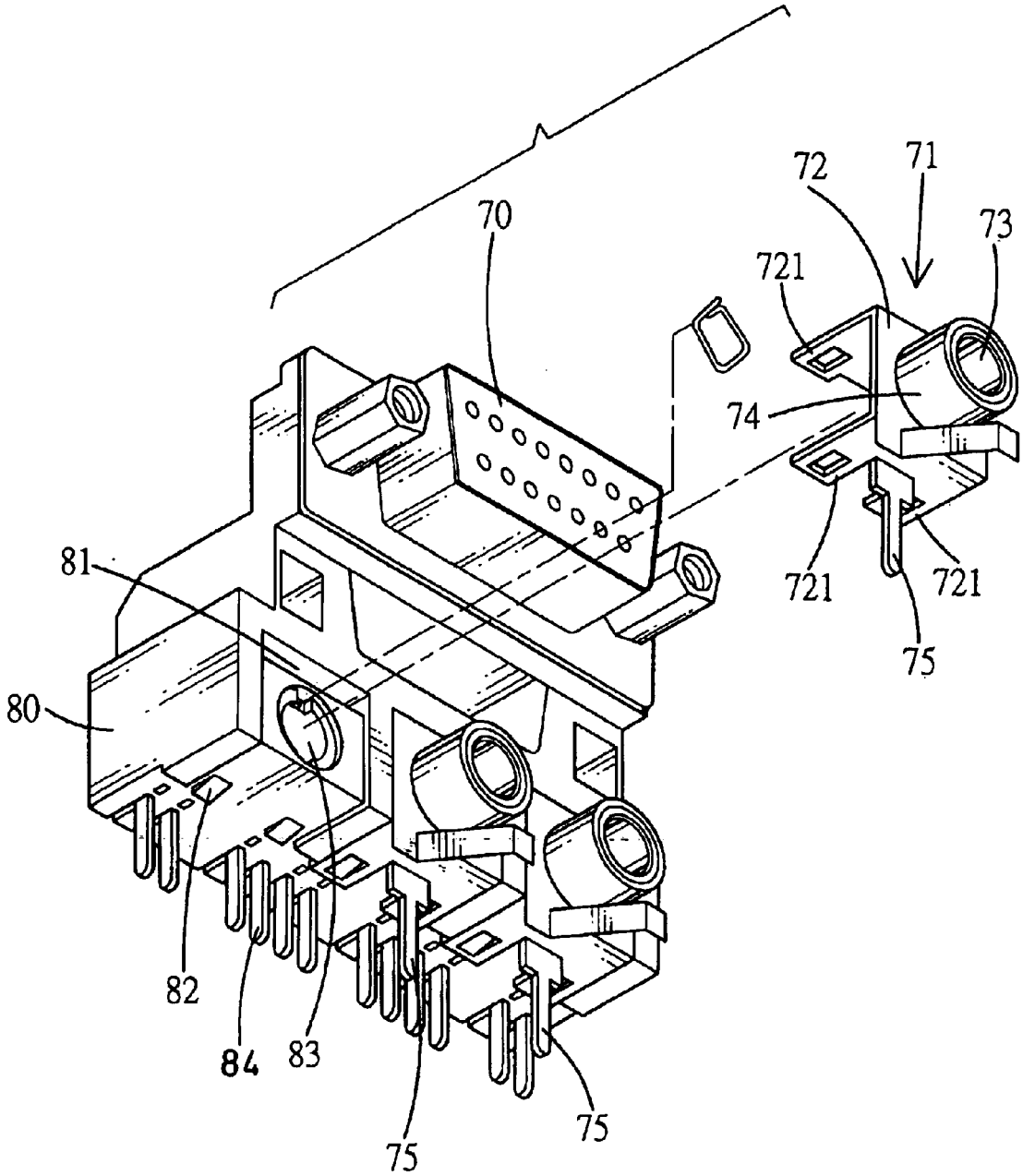
FIG. 4 PRIOR ART
FIG. 4 is an exploded perspective view of a conventional electrical connector.
Figure 5:
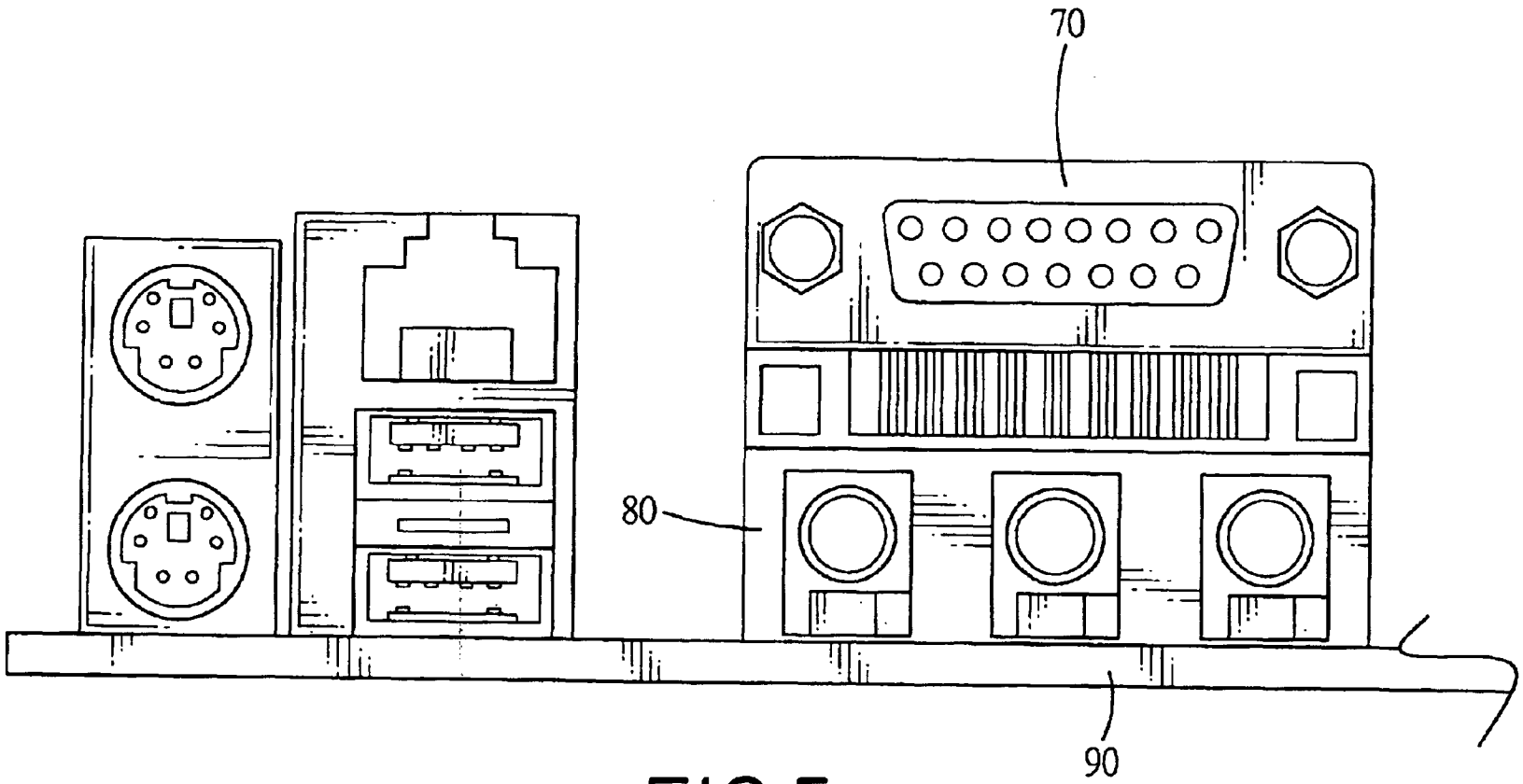
FIG.5 PRIOR ART
FIG. 5 is an operation view showing that the electrical connector of FIG. 4 is mounted to a main board.

With reference to FIGS. 2 and 3, since the ground plate (30) is commonly contacted with all signal terminals (40), all signal terminals (40) can share the single ground pin (35). Therefore, the total amounts of conductive pins that include the ground pin (35) and the signal pins (14) is effectively reduced. When the electrical connector of the present invention is mounted on a main board (90), the welding process can be simplified.

The invention may be varied in many ways by a skilled person in the art. Such variations are not to be regarded as a departure from the spirit and scope of the invention, and all such modifications are intended to be included within the scope of the following claims.

What is claimed is:

1. An electrical connector comprising:

a body having a mounting surface that is defined by a plurality of openings; and a ground plate having a first surface that abuts against the mounting surface of the body, the first surface defined by a plurality of holes corresponding to the plurality of openings, wherein a plurality of signal terminals are retained in the plurality of holes, and wherein the plurality of signal terminals are commonly contacted to each other through the ground plate and to a ground pin of the ground plate.

2. The electrical connector of claim 1, wherein the ground plate is made up of a conductive plate and has multiple buckling plates perpendicularly extending from edges of the conductive plate, wherein the multiple buckling plates are able to clasp on the body.

3. The electrical connector as claimed in claim 2, wherein one of the multiple buckling plates is clasped on the bottom surface of the body, and the ground pin is formed from the buckling plate clasped on the bottom surface.

4. The electrical connector as claimed in claim 3, wherein multiple protrusions are formed on surfaces adjacent to the mounting surface of the body, whereby each buckling plate is able to clasp on each protrusion.

5. The electrical connector as claimed in claim 4, wherein each signal terminal is composed of a conductive sleeve and a colored rubber ring surrounding the conductive sleeve.

6. The electrical connector of claim 1, wherein the body has a substantially rectangular shape.

7. The electrical connector of claim 1, wherein each of the plurality of signal terminals comprises a conductive sleeve, and the plurality of conductive sleeves are commonly contacted to each other for electrical grounding through the ground pin of the ground plate.

* * * * *